United States Patent [19]

Johnson

[11] 4,437,420

[45] Mar. 20, 1984

[54] DRIVE ROLL MONOGRAMMER

[75] Inventor: Kenneth M. Johnson, Westfield, N.J.

[73] Assignee: The Singer Company, Stamford, Conn.

[21] Appl. No.: 327,861

[22] Filed: Dec. 7, 1981

[51] Int. Cl.[3] ..... D05C 1/02

[52] U.S. Cl. ..... 112/103; 112/240

[58] Field of Search ..... 112/103, 121.12, 266.1, 112/121.15, 320, 322, 240

[56] References Cited

U.S. PATENT DOCUMENTS 3,865,059 2/1975 Jackson .

FOREIGN PATENT DOCUMENTS 46-10137 3/1971 Japan .
46-9614 3/1971 Japan .
47-21252 10/1972 Japan .
49-49578 12/1974 Japan .

OTHER PUBLICATIONS

U.S. Application Ser. No. 221,098, filed Dec. 29, 1980.

*Primary Examiner*—Werner H. Schroeder
*Assistant Examiner*—Andrew M. Falik
*Attorney, Agent, or Firm*—Edward P. Schmidt; Robert E. Smith; Edward L. Bell

[57] ABSTRACT

A continuous monogrammer utilizing a peripheral frame to support therein a pair of rollers and drive mechanism therefor to transport a continuous strip of material laterally beneath the sewing machine needle. A bridge straddles the rollers and is slidingly supported on a pair of shafts on opposite sides of the peripheral frame. The bridge is affixed to the sewing machine presser bar so as to elevate the frame and rollers thereby. A second drive mechanism is carried by the bridge and provides an operative connection between the bridge and the peripheral frame so as to move the peripheral frame and the work fabric upon which it rests in the longitudinal direction beneath the sewing needle.

4 Claims, 3 Drawing Figures

DRIVE ROLL MONOGRAMMER

DESCRIPTION

BACKGROUND OF THE INVENTION

This invention is in the field of sewing machines; more particularly, it is concerned with a mechanism supportable on a sewing machine bed for the purpose of moving a work material for continuous stitching thereon of words, patterns or monograms.

Prior art devices for monogramming or continuous patterning have been limited by the bight capability of the sewing machine. Thus, for example, in the Japanese Patent Publication No. 49578/74 (Dec. 27. 1974—Takatomi) there is shown a device which may be operated by the needle bar of the sewing machine to feed a work material beneath a sewing needle in order to generate a continuous pattern having a width equal to the bight capability of the sewing machine.

In other prior art devices, a form of an embroidery hoop is utilized to support the work material beneath the sewing machine, and move the work material in the formation of larger patterns or writings. Such devices are shown in the U.S. Pat. Nos. 4,195,581 and 3,734,038 of O'Hara and Takatomi, respectively.

There is also the commonly assigned U.S. patent application Ser. No. 211,098 of D. R. Davidson, filed Dec. 29, 1980. That application discloses a continuous monogrammer utilizing a first frame to carry a pair of spaced apart belts driven by stepper motors to transport a wide band of work material laterally beneath a sewing machine needle. A second stepper motor carried by a second frame attached to the sewing machine presser bar rotates a gear in mesh with a worm carried by the belt frame to cause the belts and work material transported thereby to move in a longitudinal direction beneath the sewing machine needle in the formation of monograms, patterns, or words having a height equal to the depth of the work material. However, the prior art device utilized two separate frames which created some difficulty while using the machine, especially in attempting fabric repositioning. Further, fabric control during stitching was somewhat of a problem because of the large unsupported distance between the driving belts.

What is required is a one-piece monogrammer which will exert a substantial degree of control over the work material being transported thereby.

SUMMARY OF THE INVENTION

The above objectives are attained in a continuous monogramming device which is attachable to the presser bar of a sewing machine and operates to feed work material through the sewing machine continuously, and reversibly, by means of feed drive rollers. A one-piece peripheral frame is provided to support the rollers extending in the longitudinal direction on both sides of the sewing machine feed dog. These rollers are joined by a belt drive and gear train to a first stepper motor also supported by the frame. Rotation of the stepper motor rotates the rollers and transports work material upon which the rollers rest in the lateral or X direction in an unlimited amount. The frame also slidably supports a bridge which is movable within the frame in the Y direction. The bridge may be connected to a sewing machine presser bar and carries a second stepper motor which rotates a nut encircling a lead screw carried by the frame so that the second stepper motor may vary the position of the frame in the Y direction. The result is that work fabric may be fed in the X direction in an unlimited amount, and may be positioned in the Y direction within the depth of the frame. Control of the stepper motors and of the sewing instrumentalities of the sewing machine may be implemented by electronic means within the sewing machine frame or by auxiliary electronic means externally thereof having a connection to a stitch cycle sensor in the sewing machine to release data at the proper time.

DESCRIPTION OF THE DRAWINGS

The novel features which are considered as characteristic for the invention are set forth in particular in the appended claims. This invention itself, however, both as to its construction and its method of operation, together with additional objects and advantages thereof, will best be understood from the following description of specific embodiments when read in conjunction with the accompanying drawings in which:

DETAILED DESCRIPTION OF THE INVENTION

Figure 1:
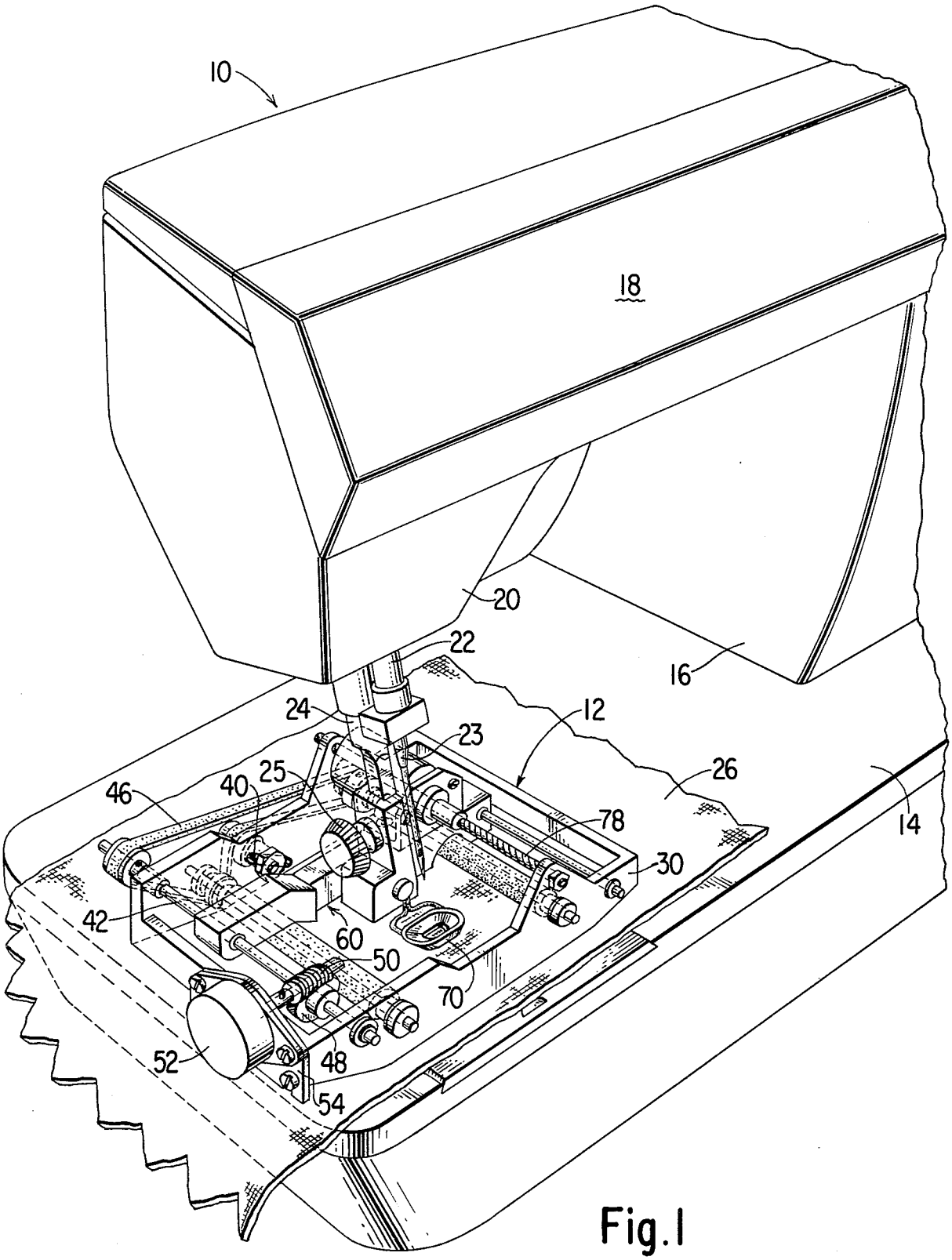
FIG. 1 is a perspective view of a portion of a sewing machine in which the invention may be utilized and with the invention attached thereto.

Referring now to FIG. 1, there is shown a portion of a sewing machine 10 in which there has been supported the drive roll monogrammer 12 subject of this application. The sewing machine 10 includes a bed portion 14 from which a standard 16 rises to support a bracket arm 18 which terminates in a head portion 20. The head portion 20 supports therein for endwise reciprocation in the usual manner a needle carrying bar 22 to the end of which there is affixed a sewing needle 23. Supported in the head portion 20 behind the needle bar 22, is a presser bar 24 to the end of which there is affixed the usual attachment thumb screw 25 for attaching to the presser bar any one of a variety of different presser feet or, as in the instant ocassion, for attaching a feeding aid such as the subject monogrammer 12. The sewing machine 10 is shown with a work fabric 26 in the form of a wide tape disposed on the work supporting bed 14 beneath the drive roll monogrammer 12. The work fabric 26 may be fed laterally beneath the sewing needle 23 by a portion of the drive roll monogrammer 12 which may be better understood by reference to FIG. 2.

Figure 2:
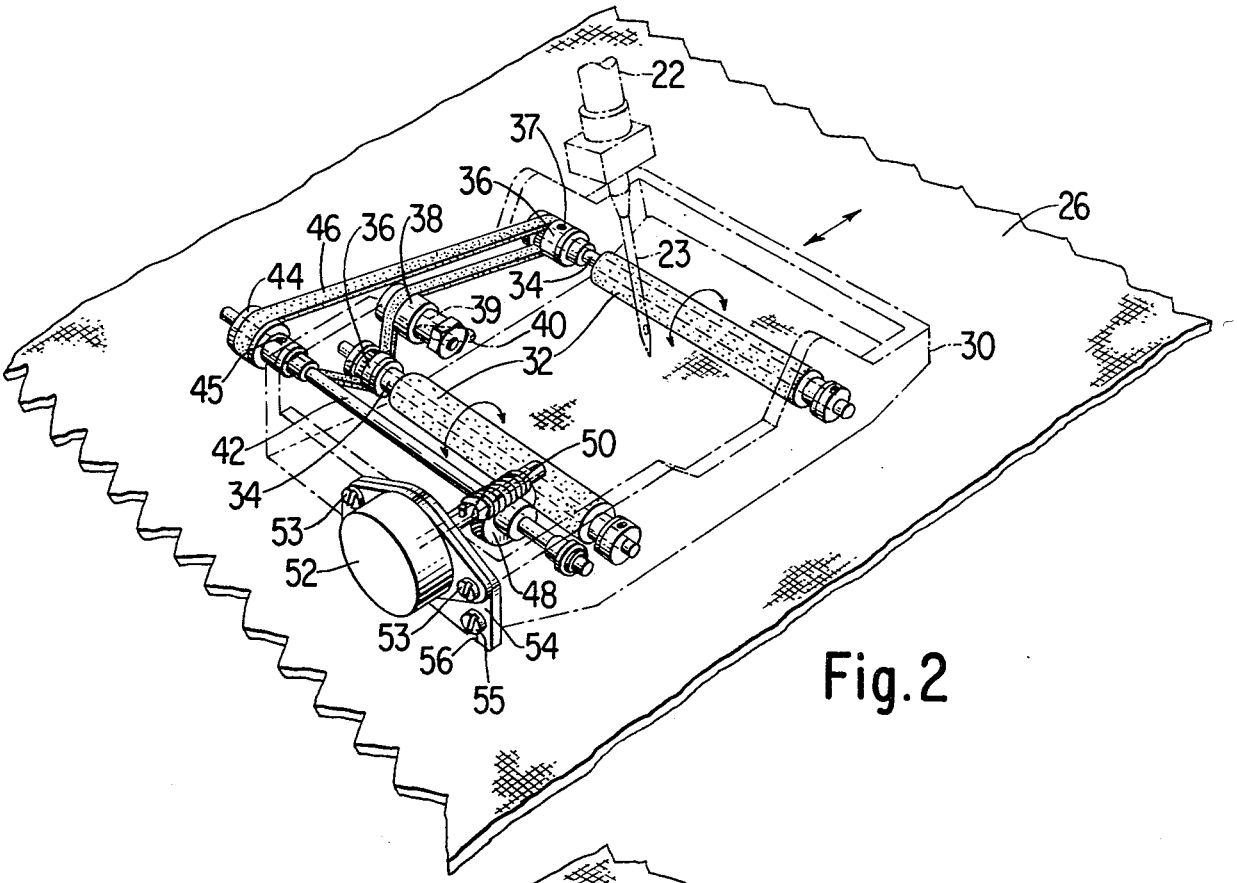
FIG. 2 is an enlarged perspective view of a portion of the invention shown in FIG. 1 which achieves lateral feed of a work material in the lateral direction under the needle of the sewing machine; and, FIG. 3 is an enlarged perspective view of that portion of the monogrammer shown in FIG. 1 which is responsible for longitudinal positioning of the work material within the extent of the frame of the monogrammer.

Referring to FIG. 2, there is shown that portion of a drive roll monogrammer 12 which feeds the work fabric 26 laterally beneath the sewing needle 23. The drive roll monogrammer 12 is fashioned with a peripheral frame 30 which rotatably supports a pair of spaced apart parallel drive rolls 32. The drive rolls 32 are supported on and attached to shafts 34 which extend through the peripheral frame 30 and are journalled therein. The shafts 34 extend beyond the rear of the peripheral frame 30 and have attached thereto toothed belt pulleys 36 which are attached thereto for example, by screws 37, only one of which is visible. An idler pulley 38 carried on a shouldered stub shaft 39 extends through a slot 40 in the peripheral frame 30 for a purpose which will be more fully explained shortly.

A driven shaft 42 is also journalled for rotation in the peripheral frame 30 and supports thereon in alignment the peripheral frame 30 and supports thereon in alignment with the idler pulley 38 and pulleys 36, a fourth pulley 44 retained thereto by means of set screw 45. A drive belt 46 extends about the first two pulleys 36 and the fourth pulley 44, with the idler pulley 38 bearing against the outside surface thereof by adjusting its position within the slot 40 in the peripheral frame 30 in order to eliminate slack. The driven shaft 42 also has affixed thereto a worm gear 48, which gear is in mesh with a worm 50 carried by a shaft of a motor 52 which is preferably a stepper motor for the greatest accuracy of control. The stepper motor 52 is attached by screws 53 to a plate 54 which is connected by screws 55 extending through slots 56 therein to the peripheral frame 30. The slots 56 provide adjustability for the mesh of the worm 50 to the worm gear 48. The drive rolls 32 are of a diameter sufficient to extend beneath the peripheral frame 30 and rest upon the work fabric 26. Thus, as the stepper motor 52 is actuated, the driven shaft 42 rotates and, through the fourth pulley 44, rotates the drive belt 46 so as to rotate the pulleys 36 which are carried by the shaft 34 extending through and affixed to the drive rolls 32. The result is that the work fabric 26 moves laterally underneath the sewing needle 23 in a direction selected by the direction of rotation of the stepper motor 52. Because each drive roll 32 rotates at the same speed, the work fabric 26 moves uniformly beneath the sewing needle 23. Work fabric 26 initially flat on the bed portion 14 remains flat because nearly each lateral thread of the work fabric is fed by one drive roll 32 and drawn away by the other drive roll at the same speed, owing in large part to the material thereof which is selected for its fabric feeding capability.

Figure 3:
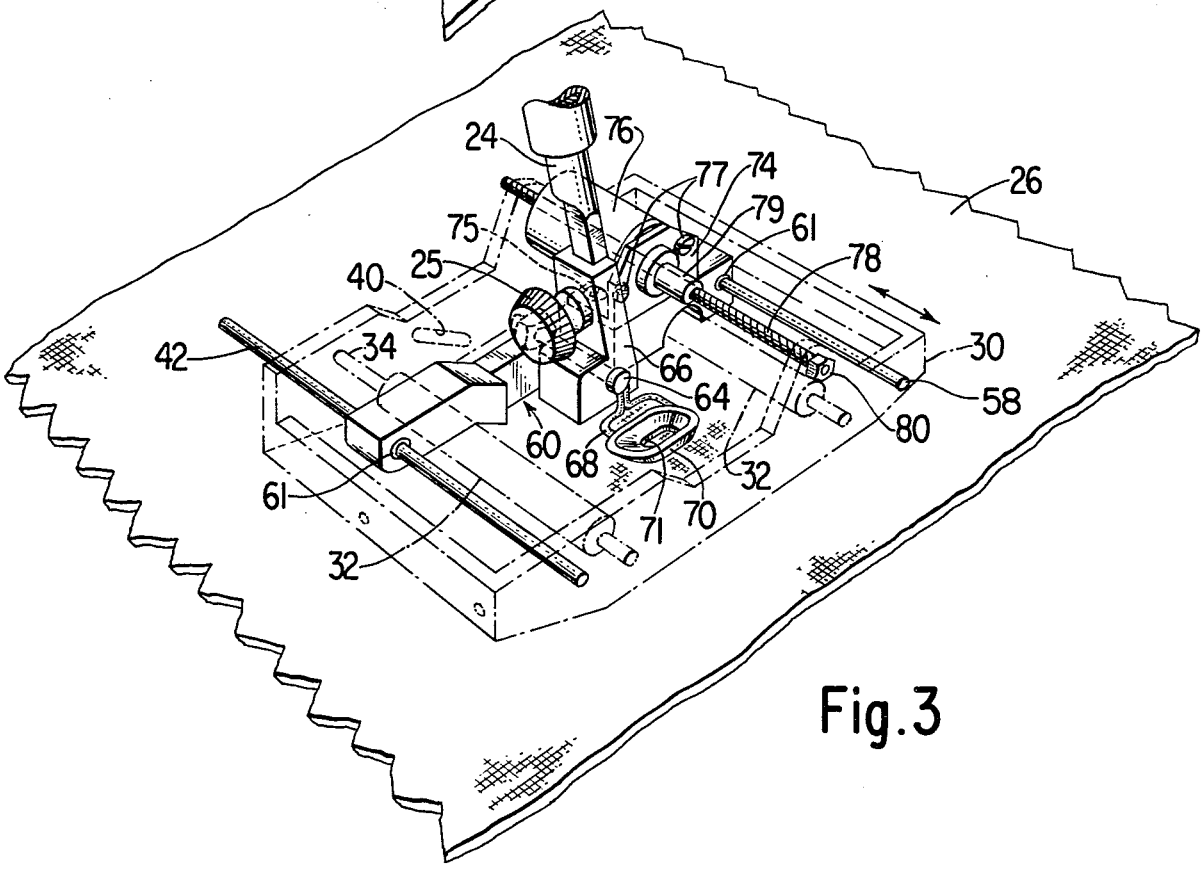

Thus far has been disclosed the ability to move the work fabric 26 along a line beneath the sewing needle 23. However, in order to be able to produce monograms or patterns, an additional motion of the work fabric 26 is required at right angles to the lateral motion of the work fabric. In order to attain the necessary longitudinal motion, an additional apparatus is required for the drive roll monogrammer 12, which apparatus is shown in FIG. 3 apart from that apparatus heretofore described which generated lateral capability. Thus, there is disclosed, in phantom, the peripheral frame 30, as well as the drive rolls 32 and shafts 34 on which they are supported. The driven shaft 42 is shown located on one side of the peripheral frame 30 and a support shaft 58 is shown on the opposite side of the peripheral frame. A bridge member 60 extends laterally across the peripheral frame 30 and is supported on bearings 61 which encircle the driven shaft 42 and the support shaft 58. Thus, the bridge member 60 is slidable on the driven shaft 42 and support shaft 58 on the bearings 61. The bridge member 60 has attached thereto on pivot pin 64 a presser bar clamp 66 which pivots on the pivot pin. The presser bar clamp 66 may be attached to the presser bar 24 by means of the attachment thumb screw 25. A wire form 68 carried behind the head of the pivot pin 64 carries a stripper foot 70 immediately above a work fabric 26 in order to facilitate stripping of the work fabric from the sewing needle 23. The stripper foot 70 is fashioned with an aperture 71 through which the sewing needle 23 extends. Thus, it is apparent that when the presser bar 24 is attached to the presser foot 70 by the attachment screw 25, the bridge member 60 may be elevated and by means of its connection to the driven shaft 42 and support shaft 58, will elevate the peripheral frame 30 to take the drive rolls 32 out of contact with the work fabric 26.

Attached to the bridge member 60 by screws 75, only one of which is shown, is an L bracket 74. The L bracket 74 supports, preferably, a second stepper motor 76 which is attached thereto by screws 77. The second stepper motor 76 is of a form in which the rotor of the stepper motor encircles and is threadedly connected to a lead screw 78 which is situated centrally of the stepper motor, by the rotating nut 79. The lead screw 78 is connected to the peripheral frame 30 by nut 80 such that rotation of the rotor of the second stepper motor 76, which is fixed to bridge member 60, and thus to the presser bar 24, will cause the peripheral frame 30 and drive rolls 32 and other equipment attached thereto to move longitudinally or normal to the lateral motion of the work fabric 26 achieved by the drive rolls 32 so as to slide the work fabric in a longitudinal direction on the bed portion 14.

Thus, by combining lateral motion with longitudinal motion effected by means of stepper motors 52, 76, respectively, large patterns and monograms may be implemented on the work fabric 26. Practically speaking, the depth of the work fabric 26 is limited only to that which may be accommodated on the depth of the bed portion 14 of the sewing machine 10, inasmuch as the peripheral frame 30 may be fashioned large enough to accommodate a lead screw 78 which will permit shifting of the work fabric 26 from one extreme to the other across the width of the work supporting bed portion 14. Alternatively, a bed extension may be fabricated which will enlarge the necessary part of the bed portion 14 to accommodate whatever size of monogram or pattern is desired. The use of the drive rolls 32 serves to maintain the work fabric 26 taut in those areas where the sewing needle 23 would penetrate the work fabric. Thus, better control of the fabric is achieved with little or no potential for buckling thereof in the critical area beneath the sewing needle 23. The use of the lead screw 78 which extends down the middle of the stepper motor 78 provides a compact device for controlling the longitudinal position of the peripheral frame 30. Also, in this fashion, gear and rack forces are avoided as well as critical alignment problems necessary to avoid gear tooth wear. The one-piece frame construction simplifies placement of cloth beneath the monogrammer 12, since elevation of the peripheral frame from the work fabric may be facilitated with one operation. The wide stance of the bridge member 60 within the peripheral frame 30 reduces to a considerable degree side play of the monogrammer 12.

Although the invention has been described in its preferred form and with a certain degree of particularity, it is understood that the present disclosure of the preferred form has been made by way of example and that numerous changes in the details of construction and the combination and arrangement of parts may be resorted to without departing from the spirit and scope of the invention.

I claim:

1. A work manipulating mechanism for use with a sewing machine having a frame including a work supporting bed, said frame supporting a presser bar, a needle bar, a sewing needle supported on the end of said needle bar, means for supporting said needle bar for endwise reciprocation in the formation of stitches, and actuating means for implementing endwise reciprocation of said needle bar, said work manipulating mechanism comprising:

a pair of spaced apart rollers;

means for rotatably supporting said rollers in contact with work material supported on said work supporting bed, said supporting means including a substantially rectilinear peripheral frame;

a first shaft rotatably supported by said peripheral frame paralleling said rollers;

means for connecting said shaft to said rollers to transmit rotation of one to the other;

a first drive means carried by said peripheral frame and operatively connected to said first shaft for transmitting selected rotation to said rollers;

a second shaft supported by said peripheral frame parallel to said first shaft;

a bridge extending above said rollers and slidably supported by said first and said second shafts;

means on said bridge for connecting said bridge to said presser bar for support thereof;

and a second drive means supported by said bridge and operatively connected to said peripheral frame for selectively moving said peripheral frame relative to said bridge.

2. A work manipulating mechanism as claimed in claim 1 wherein said first and second drive means further includes a first and second stepper motor.

3. A work manipulating mechanism as claimed in claim 2 wherein said first and second shafts are located on opposite extremities of said substantially rectilinear peripheral frame, said bridge extending over said rollers between said first and second shafts.

4. A work manipulating mechanism as claimed in claim 3 wherein said second drive means further includes a nut rotated by said second stepper motor and, a lead screw carried by said peripheral frame and threaded to said rotating nut.

* * * * *